US008900032B2

(12) United States Patent
Punsal

(10) Patent No.: US 8,900,032 B2
(45) Date of Patent: Dec. 2, 2014

(54) ATHLETIC SUPPORT BRASSIERE

(76) Inventor: Alena Punsal, Hardwick, NJ (US)

( * ) Notice: Subject to any disclaimer, the term of this patent is extended or adjusted under 35 U.S.C. 154(b) by 318 days.

(21) Appl. No.: 13/215,355

(22) Filed: Aug. 23, 2011

(65) Prior Publication Data

US 2012/0045967 A1 Feb. 23, 2012

Related U.S. Application Data

(60) Provisional application No. 61/401,993, filed on Aug. 23, 2010.

(51) Int. Cl.
*A41C 3/00* (2006.01)
*A41C 3/12* (2006.01)

(52) U.S. Cl.
CPC ..... *A41C 3/0057* (2013.01); *A41C 3/122* (2013.01)
USPC ..... 450/31; 450/17; 450/23

(58) Field of Classification Search
USPC ..... 450/17, 20, 21, 23, 31–34, 62, 63, 78, 450/79
See application file for complete search history.

(56) References Cited

U.S. PATENT DOCUMENTS

| | | | | | |
|---|---|---|---|---|---|
| 1,584,525 | A | * | 5/1926 | Freeman | 450/62 |
| 1,972,045 | A | * | 8/1934 | Julius | 450/62 |
| 2,284,382 | A | * | 5/1942 | Elberfeld | 450/62 |
| 2,487,210 | A | * | 11/1949 | Rae Barco | 450/62 |
| 2,518,975 | A | * | 8/1950 | Chisholm | 450/62 |
| 2,574,962 | A | * | 11/1951 | Curran | 450/48 |
| 2,650,363 | A | * | 9/1953 | Lo Cascio | 450/63 |
| 2,660,729 | A | * | 12/1953 | Katz | 450/48 |
| 2,683,879 | A | * | 7/1954 | Dollarhide | 450/78 |
| 2,863,460 | A | * | 12/1958 | Monroe | 450/11 |
| 3,189,028 | A | | 6/1965 | Dormire | |
| 3,746,007 | A | * | 7/1973 | Hand et al. | 450/31 |
| 4,191,192 | A | | 3/1980 | McDavid | |
| 4,325,378 | A | | 4/1982 | Wilkinson | |
| 4,444,191 | A | | 4/1984 | Harned | |
| 5,427,563 | A | | 6/1995 | Manning | |
| 5,643,043 | A | | 7/1997 | Pflum | |
| 5,797,787 | A | * | 8/1998 | Kaye | 450/30 |
| 5,968,003 | A | | 10/1999 | Sisson | |
| 6,165,045 | A | | 12/2000 | Miller et al. | |
| 6,755,717 | B2 | | 6/2004 | Smith | |
| 6,811,462 | B1 | * | 11/2004 | Kenneally | 450/30 |

OTHER PUBLICATIONS

Phase Changes Fabrics Control Temperature, printed Aug. 4, 2011 from www.nasa.gov/pdf/413410main PhaseChange.pdf.

* cited by examiner

*Primary Examiner* — Gloria Hale
(74) *Attorney, Agent, or Firm* — Benjamin Appelbaum

(57) ABSTRACT

An athletic brassiere with breast band, having the general form of a brassiere, for use when engaging in vigorous physical exercise or activities, such as running, tennis, and the like. An embodiment comprises an inner liner and outer panel, an internal breast band sleeve, and a breast band slidably retained within the sleeve. The breast band has a fastener enabling the breast band length to be adjusted; the breast band is adjustable vertically and horizontally. Embodiments hold the breasts down with the breast band slidably retained within the garment, providing support and protecting the wearer from discomfort or injury from excessive upward and downward breast movement. The breast band alleviates upward and downward movement of the breasts and does not cinch, flatten or compress the wearer's breasts against the chest wall, nor lift and bold the breasts. The garment is attractive and can be worn alone or under another garment.

27 Claims, 9 Drawing Sheets

ATHLETIC SUPPORT BRASSIERE

CROSS-REFERENCE TO RELATED APPLICATIONS

This application claims the benefit of U.S. Provisional Application for Patent Ser. No. 61/401,993, filed 23 Aug. 2010, the contents of which are incorporated by reference herein in their entirety.

FEDERALLY SPONSORED RESEARCH

Not Applicable

SEQUENCE LISTING OR PROGRAM

Not Applicable

FIELD OF THE INVENTION

The present invention generally relates to athletic support brassieres, specifically to sports bras utilized for preventing excessive upward and downward breast movement during vigorous physical exercise or activities.

BACKGROUND OF THE INVENTION

Reputable studies have confirmed that exercise and physical fitness, especially running and jogging, are immensely popular sports and wellness activities for countless people: the young and the mature, athletic and struggling athletes, pregnant and postpartum athletes, alike. Uniformly, female and large breasted male athletes suffer from an inaccessibility to a commercial sports bra that provides a comfortable, easily adjustable, and supportive device for their breasts to stop potentially painful and damaging excessive upward and downward movement during vigorous physical exercise or activities such as running, jogging, aerobic exercises, horseback riding, etc.

Female athletes, especially young athletes participating in athletics (for example only, physical education classes) tend to be sensitive and easily embarrassed by excessive movement of their breasts when exercising in front of peers. Frequently, teenage girls forgo vigorous exercise in physical education class, at a detriment to their grade and self esteem, so as to avoid unsolicited and discomforting attention.

Female roadrunners, runners who run or jog on public highways instead of on a closed or private track or on cross-country courses, frequently receive uninvited gawking or staring from passing motorists, placing the runners in an unwanted and sometimes precarious situation simply because of uncontrolled and excessive upward and downward breast movement caused by ineffective sports bras found in the sports clothing market today.

Serious athletes, but especially runners, do not willingly stop exercising while pregnant. In addition, postpartum and lactating women, similar to pregnant women, require a breast supporter that can readily be adjusted to changing conditions week-by-week and month-by-month, such as, for example only, size or tenderness of the breasts before and after childbirth. Traditional sports bras do not accommodate these changing conditions.

All female athletes, regardless of age and ability require breast support when engaged in vigorous physical exercise or activities to maintain personal comfort and reduce the chance of short-term pain or long-term damage, such as the sagging and tearing of breast tissue and ligaments of the chest.

An ardent lifelong runner who continued to run during and within a reasonable time after childbirth found, however, after exhaustive searching, no product on the market could accommodate the tenderness and substantial growth and flux of her breasts before, during, and after lactation, or during a period of substantial weight loss. This individual sought a garment that could stabilize her breasts from excessive upward and downward movement, that was soft so as not to chafe the skin around the breast area, especially the nipples, yet firm and stretchable to be easily tightened or loosened depending on her activity level; did not restrict breathing by excessive chest compression; could be adjusted without a complete cessation in activity, assistance or having to acquire privacy; and still looked attractive so as not to be perceived as an embarrassing breast binding apparatus; and could be worn with or without an outer shirt.

It was determined that conventional sports bras, even those made specifically for vigorous activities such as running and aerobic exercises, were incapable of offering the support promised. Several different makes and models of sports bras were tried without success, as well as trying to "double up" sports bras, wearing two sports bras at one time, one smaller than the other. These caused pinching and chafing where the two bras met, especially under the arms and on the top portions of the breast, and it constricted breathing. It was discovered that wearing an ACE® (Registered trademark of 3M Company, St. Paul, Minn.) or similar type of bandage around the chest did provide the support being sought after; however, the wrap constricted breathing, was difficult and awkward to put on, impossible to adjust without removing an over-shirt, was unsightly and bulky, used metal clips and fasteners to secure the elastic bandage around the chest, and cut into the loose skin under the arms and back. As will be apparent in the present specification, embodiments of the present invention resolve these problems.

The present invention, in a first embodiment, relates to a chest-encircling device, called a breast band, that is enclosed within a sports type bra, hereafter referred to as an athletic brassiere with breast band, with a zippered front. The present invention, in a second embodiment, relates to a chest-encircling device, called a breast band, enclosed within an elongated exercise shirt with a zippered front. The breast band prevents excessive upward and downward movement of the breasts by using an adjustable and firm, yet soft and pliable band, which is placed on the upper portion of the breasts and contours to the human body. The breast band, which is an elastic strap, works with gravity to prevent the breasts from excessively bouncing upward and downward during vigorous exercise and does not overly compress one's chest or constrict breathing.

Embodiments of the athletic brassiere with breast band function to stabilize the band and encapsulate, not to compress or shape the breast, allowing the breasts to have a natural feminine appearance and shape; and to be easily placed at an infinite number of positions on one's breasts to accommodate one's anatomy. The one-piece, chest-encircling, flexible band with two ends, which in embodiments is not attached or sewn to the athletic brassiere with breast band may be sewn latitudinally to the posterior portion of the bra. The band is designed to rest inside a single or double layer of thin, flexible spandex type cloth sheath, which is sewn to the interior of the athletic brassiere with breast band and wraps continuously around the back and torso of the person using the present invention by attaching the ends together in the front and over the muscular portion and some of the fatty portion of one's breasts using a fastener. In embodiments, the band is one piece and has two ends. The band's length is dependent on the size of the athletic brassiere with breast band; but regardless of the bra's size the band's length will be proportionate to the athletic brassiere with breast band. On one end, a longitudinally placed or sewn fastener is situated to be complementary to the opposite band. In embodiments, a contact sensitive, reusable fastener is adjustable on the opposite band to numerous positions enabling the fastener is secure the opposite end of the band along its entire length. In embodiments, a preferred width of the band is at least three inches in width, made from soft, pliable elastic material which may be similar to neoprene and/or an ACE® bandage.

In embodiments, the fastener is VELCRO® (Registered trademark of Velcro Industries, B.V., Curacao), which is disclosed in U.S. Pat. No. 2,717,437, or a similar type of hook and loop fastener. This patent is incorporated by reference herein and includes a disclosure of a fastening means including a gripping strip having a number of small, outwardly extending, closely spaced flexible hooks in which the hooks engage loosely knitted, velvet type fabric by a transverse engagement of the strip having the hooks with the velvet-like fabric. This type of fastening means is well known in the art and contains no metal.

A closure, such as a zipper, is attached to the external panels of the athletic brassiere with breast band and is designed to close the front panels together when zipped. On one side of the athletic brassiere with breast band, attached to the internal and external panels is a piece of fabric, positioned behind the zipper, that protects the wearer's skin from chafing, and allowing the chest-encircling band to be reached without completely unzipping or removing the athletic brassiere with breast band, ensuring comfort and privacy for the wearer.

Embodiments of the athletic brassiere with breast band can be provided in any number of colors. It is made from light, stretchable and breathable material. A heavier gauge material or fabric may be used for the external panel. The purpose of the athletic brassiere with breast band is to provide a comfortable carrier for the breast band and to assist in concealing the breasts by means of wrapping them with the breast band material. An embodiment of the athletic brassiere with breast band does not contain cups or any metal pieces, except for the zipper at the midline connecting the front panels together. Alternate embodiments of the athletic brassiere with breast band may contain cups. Embodiments of the present invention allow one to wear the correct size athletic brassiere with breast band, ensuring comfort and appeal for the wearer, as well as minimizing upward and downward movement of the wearer's breasts.

Various sports bras and breast bands disclosed in other patents do not provide adequate support for athletic women in a comfortable or attractive way, or the sports bras are attractive but do not provide ample breast support. Those patents which seemed most pertinent to the present invention are described below.

The R. D. Dormire U.S. Pat. No. 3,189,028, dated Jun. 15, 1965, shows a breast supporter and band designed to be readily adaptable to changing conditions of the breasts after childbirth. The principle objective of the Dormire invention is to provide daily breast support after childbirth and during postnatal care. The invention is designed to replace a traditional bra, which, as stated earlier, does not and cannot offer support for athletes' breasts while engaging in vigorous exercise or activities like running, horseback riding, tennis, etc.

An objective of the present invention is to prevent excessive upward or downward movement to the wearer's breasts during vigorous exercise or activities by utilizing a breast band, which firmly and comfortably holds the breasts down, not allowing excessive upward or downward bouncing of the breasts, working with gravity, constructed of a stretchable band built inside an attractive and stylish athletic brassiere with breast band or an elongated exercise shirt, which can be worn alone or under another garment.

The McDavid U.S. Pat. No. 4,191,192, dated Mar. 4, 1980, shows an athletic brassiere consisting of an elastic band which encircles the chest below the armpits and above the breasts; and it is attached to breast cups which are attached to the breast band; a strap extends from the chest and loop around the wearer's legs. The principle objective of the McDavid invention is to flatten the wearer's breasts against the body and "hold them down" by exerting a downward pull on the band and the cups with the elastic straps, which wrap not just around one's chest but below one's hips and around one's legs.

The present invention does not require the additional straps stitched into the breast band, nor straps to be looped around one's legs to maintain breast support. The breast band is built into the athletic brassiere with breast band, providing the wearer with a supportive and comfortable athletic brassiere with breast band garment. Elongated straps around one's legs would not be comfortable, practical, or attractive to wear.

The Wilkinson U.S. Pat. No. 4,325,378, dated Apr. 20, 1982, shows a sports garment comprised of an inner liner, breast cups, and an outer breast supporting flap fitted over the liner, cinched together on the distal portion of the breasts towards the body's midline by use of a tapered section through a loop. These flaps, which cover a good portion of the breasts, are cinched together with inward pressure, crushing the breasts together with a compressive force in an uncomfortable fashion. The Wilkinson invention is stated to work by cinching the outer flaps together, by compression, over the breasts. The outer flaps are connected to the lining behind the breast engaging pockets and when cinched create an inward pressure. This pressure and encapsulation is uncomfortable, excessively hot for the wearer, especially for large breasted women, and unattractive.

Embodiments of the present invention do not cinch or crush the breasts together, which would substantially distort the appearance of the wearer's breasts into an unflattering shape; nor do they mitigate the effectiveness of the band by placing the breasts in an uncomfortably close proximity by essentially combining two separate breasts into one large breast mass in the center of one's chest and cause excessive heat, rubbing, and sweating by having the wearer's breasts together in such close proximity.

The Harned U.S. Pat. No. 4,444,191, dated Apr. 24, 1984, discloses a comfort garment. The garment is comprised of three major portions, all which are said to work dependently of one another: an encircling midregion strap, a slanting or angling strap over the upper portions of the breasts, and a halter or strap which hugs, firms or otherwise restricts breast area movement. The brassiere disclosed in Harned is comprised of a vest, which the front panels are alleged to restrict upward and downward movement of the wearer's breasts. To attempt this, the vest needs to be exceedingly tight. In addition, angled straps are said to add supplemental support to restrict breast movement. By positioning the angled straps over a breast, whereas the outer or distal portion is lower than the inner or proximal portion of the breast, by tightening the strap the wearer will effectively pull the breasts together, crushing them. Similar to the shortcomings of the Manning, Sisson, and Wilkinson patents, having the elastic band attached to the sides of the garment will cause the wearer's breasts to be cinched and crushed together into one large breast mass in the center of one's chest; and cause excessive heat, rubbing, and sweating by having the wearer's breasts together in such close proximity.

Embodiments of the present invention do not cinch or crush the breasts together, which would substantially distort the appearance of the wearer's breasts into an unflattering shape; nor do they mitigate the effectiveness of the band by placing the breasts in an uncomfortably close proximity by essentially combining two separate breasts into one large breast mass in the center of the wearer's chest; and cause excessive heat, rubbing, and sweating by having the wearer's breasts in such close proximity. In addition, the breast band in the present invention is fully adjustable to an infinite number of positions on and over one's breast mass and adjustable to the comfort of the wearer.

The Manning U.S. Pat. No. 5,427,563, dated Jun. 27, 1995, shows a breast wrap designed with two rectangular open-ended pouches having pockets for crushed ice to be placed on top of the breasts. The principle objective of the Manning invention is to alleviate discomfort and nipple leakage associated with postpartum engorgement and not for the use of supporting one's breasts during vigorous physical exercise or activities such as jogging.

The Pflum U.S. Pat. No. 5,643,043, dated Jul. 1, 1997, shows a brassiere for female athletes consisting of an elastic type panel located in the upper portion of the brassiere and variably affixed by means to the brassiere shoulder straps. The garment is also provided with a bivalved pocket for inserting a contoured pad used to encapsulate the breast. The brassiere disclosed in the Pflum patent cannot provide the downward pressure required to keep the wearer's breasts from bouncing upwards since the elastic type panel is attached to the shoulder straps. By tightening the elastic type panel the wearer will only pull the shoulder straps closer together, essentially cinching the upper portion of the wearer's breasts together and allowing the lower portion of the wearer's breasts the freedom to bounce up and down without restraint.

Embodiments of the present invention solve this problem by holding the breasts down, working with gravity, by use of the breast band wrapped inside a sleeve channel, called the internal breast band sleeve, which wraps completely around the wearer's back, instead of the sides of the garment, to maintain what may be considered perfect positioning of the breast band during vigorous physical exercise or activities. The athletic brassiere with breast band portion completes the present invention by providing a carrier and an attractive covering for the breast band in several embodiments.

Sisson (U.S. Pat. No. 5,968,003), issued Oct. 19, 1999, shows a compression bandage designed to equally compress the breasts across the entire surface of the breast area by use of an expandable band and two compression flaps, similar in purpose to the Manning patent. The objective of the Sisson invention is to provide equal compression to a postoperative breast to effectively prevent hematoma or ecchymosis and not for supporting one's breasts during vigorous activities. Similar to the Manning patent, complete and equal compression across the entire breast will not stop excessive upward and downward movement of the breasts during vigorous physical exercise or activities.

The Miller et al. U.S. Pat. No. 6,165,045 (Dec. 26, 2000) discloses a brassiere for large breasted, athletic women, in the design of a traditional bra with adjustable straps, comprised of molded foam cups with ventilation holes drilled in the bottom of the cups; a nonstretchable harness, with a flange and underwire, zippered front, and three individual harnesses: an elastic waistband, wide shoulder straps, and an underarm strap, encircling one's body. The Miller et al. brassiere contains several adjustment pieces which, when tightened, encapsulate and lift the breast. The compressed, lifted breast, held at this elevated level, even with a considerable amount of compression and tightening, will not stop one's breasts from excessive bouncing during vigorous physical exercise or activities.

Embodiments of the present invention solve this problem by preventing excessive upward of downward movement of the breasts with the application of the breast band across the upper muscular portion of one's chest. The athletic brassiere with breast band portion provides a cover for the breast band and assists in concealing the wearer's breasts.

Smith (U.S. Pat. No. 6,755,717 B2, issued Jun. 29, 2004), shows a brassiere, halter or bra garment improved with laterally attached, adjustable elastic bands for inertially restraining breasts. The band, a length of elastic fabric, is attached to the sides of the sports bra and in full view over the front of the sports bra, causing the back panel of the sports bra to stretch and eventually become disfigured by constant use, effectively reducing the effectiveness of the invention to the point of failure. Like the shortcomings of the Manning, Sisson, and Wilkinson patents, having the elastic band attached to the sides of the garment will cause the wearer's breasts to be cinched and crushed together.

BRIEF SUMMARY OF THE INVENTION

It is an object of the present invention to provide an athletic brassiere with a breast band that prevents excessive upward and downward movement of the breasts by using an adjustable, comfortable and firm, yet soft and pliable band, positioned on the upper portion of the breasts and contours to the human body during vigorous exercises and activities such as running, aerobics, horseback riding, tennis and the like.

Another object of the present invention is to provide an athletic brassiere with breast band, which can protect the wearer against the development of physical problems such as the sagging and tearing of breast tissue and ligaments of the chest, caused by excessive upward and downward breast movement, while engaging in vigorous physical exercise or activities.

Another object of the present invention is to provide an athletic brassiere with breast band, which contains a stretchable band, having a VELCRO® fastener (a hook and loop fastener) (or similar hook and loop type fastener) on one end, which can be easily adjusted to suit one's needs without having to remove the entire garment or needing to search for a place of concealment to do so.

Still another object of the present invention is to provide an athletic brassiere with breast band, which can be easily and quickly applied and adjusted by the wearer without assistance, and has an attractive appearance to be worn under a separate garment or alone, without excessive bulk, complicated harnesses or straps, or give the appearance of a breast binding apparatus.

Yet another object of the present invention is to provide an athletic brassiere with breast band, which does not cinch the breasts, fully flatten or compress the breasts against the chest wall, or lift and hold the breasts, but, instead, substantially alleviates excessive upward and downward movement of one's breasts in a comfortable manner, by use of a breast band, which is housed and concealed by an internal breast band sleeve inside the athletic brassiere with breast band.

Still another object of the present invention, in an alternate embodiment, is to incorporate the support and comfort of the first embodiment's athletic brassiere with breast band into a full length or elongated type exercise shirt which substantially alleviates the wearer's breasts from excessive upward and downward movement caused by vigorous physical exercise or activities such as from running, aerobics, horseback riding, tennis and the like.

Another object of the present invention is to incorporate the support and comfort of the first embodiment's athletic brassiere with breast band into a full length exercise shirt which can protect the wearer against the development of physical problems such as the sagging and tearing of breast tissue and ligaments of the chest, caused by excessive upward and downward breast movement, while engaging in vigorous physical exercise or activities.

Still another object of the present invention is to incorporate the first embodiment's athletic brassiere with breast band into a full length exercise shirt which contains a stretchable band, having a VELCRO® fastener (a hook and loop fastener) on one end, which can be easily adjusted to suit one's needs without having to remove the entire garment or to need to look for a place of concealment to do so.

Yet another object in the present invention is to incorporate the support and comfort of the first embodiment's athletic brassiere with breast band into a full length exercise shirt which can be easily and quickly applied and adjusted by the wearer without assistance, and has an attractive appearance to be worn under a separate garment or alone, without excessive bulk, complicated harnesses or straps, or give the appearance of a breast binding apparatus.

Yet another object of the present invention is to incorporate the support and comfort of the first embodiment's athletic brassiere with breast band into a full length exercise shirt that does not cinch one's breasts, fully flatten or compress the breasts against the chest wall, or lift and hold the breasts, but, instead, substantially alleviates upward and downward movement of the wearer's breasts by use of a breast band, which is housed inside the athletic brassiere with breast band and concealed via the internal breast band sleeve in the exercise shirt.

In embodiments, these and other objects are accomplished in accordance with the principles of the present invention by use of a athletic brassiere with breast band comprising an inner liner, which secures and aligns the breast band, concealed, inside the athletic brassiere with breast band. The band is one piece, constructed of a fabric that is soft, yet, firm and stretchable. The band has a VELCRO® fastener (a hook and loop fastener), a contact sensitive, reusable fastener adjustable on the opposite band to numerous positions since the fastener is able to "grab" the opposite end of the band along its entire length. The preferred width of the band is at least three inches in width, made from soft, pliable elastic material which may be similar to neoprene and/or an ACE® bandage. In embodiments the breast band is not sewn onto the bra; however, the breast band may be attached to the midline of the rear panel of the athletic brassiere with breast band in one or more places. When the breast band is tightened it is placed over the muscular portion and some of the fatty portion of one's breasts and adjusted for comfort and support. By having the breast band encircle the wearer's torso, the band will not cinch or crush one's breasts together. The band is designed to work with gravity by holding the breasts down and not allowing them to excessively bounce upward or downward. The front external panels of the athletic brassiere with breast band are then brought together and zipped, concealing a vast majority of the breast band. The zipper allows the wearer to make adjustments to the breast band as needed without removing the entire athletic brassiere with breast band to do so; and it provides easy application and removal of the athletic brassiere with breast band while eliminating the need for the wearer's head to pass through the garment.

In the second embodiment, these and other objects are accomplished in accordance with the principles of the present invention by incorporating the support and comfort of the first embodiment's athletic brassiere with breast band into a full length exercise shirt comprising an inner liner, which secures and aligns the breast band, concealed via the internal breast band sleeve inside the full length exercise shirt. The breast band is one piece, constructed of fabric that is soft, yet, firm and stretchable. The breast band has a VELCRO® fastener (a hook and loop fastener), a contact sensitive, reusable fastener adjustable on the opposite band to numerous positions since the fastener is able to "grab" the opposite end of the band along its entire length. In embodiments, a preferred width of the band is at least three inches in width, made from soft, pliable elastic material which may be similar to neoprene and/or an ACE® bandage. The breast band, which in embodiments is not sewn onto the brassiere, may be attached to the midline of the rear panel of the athletic brassiere with breast band in one or more places in alternate embodiments. When the breast band is tightened it is placed over the muscular portion and some of the fatty portion of the wearer's breasts and adjusted for comfort and support. By having the breast band encircle the wearer's torso, the band will not cinch or crush one's breasts together. The band is designed to work with gravity by holding the breasts down and not allowing them to excessively bounce upward or downward. The front external panels of the full-length exercise shirt are then brought together and zipped, concealing the breast band. The zipper allows the wearer to make adjustments to the breast band as needed without removing the entire shirt to do so; and it provides easy application and removal of the athletic brassiere with breast band while eliminating the need for the wearer's head to pass through the garment.

Persons wearing embodiments of the athletic brassiere with breast band constructed in accordance with the principles of the present invention are able to engage in vigorous physical exercise or activities, while being protected from the problem of excessive upward and downward breast movement and the sagging and tearing of breast tissue and ligaments of the chest, and they will not appear to be wearing a breast binding apparatus.

DRAWINGS: REFERENCE NUMERALS

Figure 1:
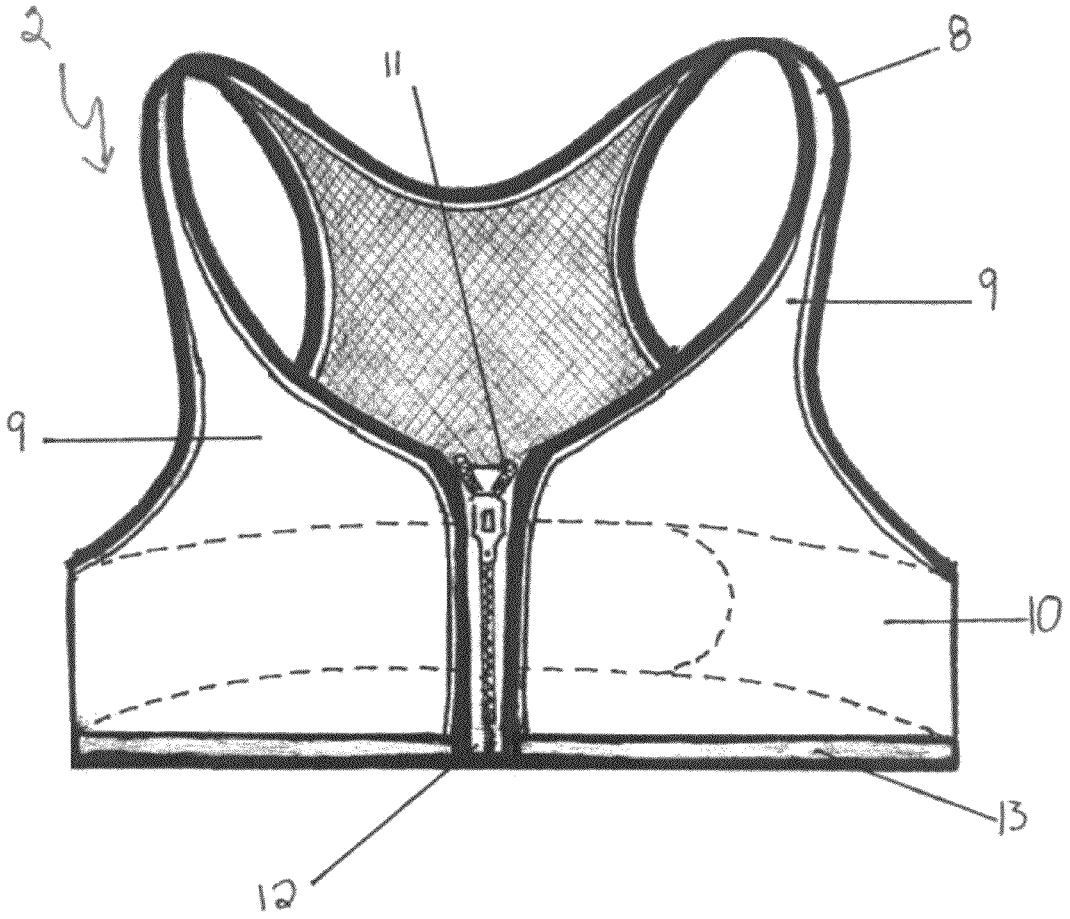
FIG. 1 is a front perspective view of an embodiment of the present invention.

The listing of reference numerals below is provided as a convenience for the reader.

2 Athletic brassiere
4 Full length exercise garment
8 Shoulder Strap
9 External Panel
10 Breast Band
11 Zipper
12 Reinforced Zipper Seam
13 Thoracic Torso Band
14 Rear External Upper Panel
15 Rear External Lower Panel
16 Reinforced Stitching Between Rear External Upper Panel and Lower Panel
17 Reinforced Stitching
18 Stitching Which Marks the Internal Breast Band Sleeve
19 Zipper Protective Fabric Strip
20 Internal Breast Band Sleeve
21 VELCRO® Fastener (a hook and loop fastener)
22 Breast Band Sleeve Opening
22A VELCRO® Positioner (a hook and loop fastener)
22B Snap Positioner
23 Inner Liner
24 Arm Holes
25 Vest Rear Inner Liner Panel
26 Vest Rear External Panel
27 Breathable Mesh
28 Waist Stitching
29 Vest Front External Panel
30 Vest Front Internal Panel
31 Vest Zipper Protective Fabric
40 Protective strip
42 Cup
50 Alternate embodiment
52 Strap
54 External panel
58 Attachment piece
60 Buckle

DETAILED DESCRIPTION OF THE INVENTION

For purposes of the present specification, certain terms may be used interchangeably. Particularly, the term "brassiere" or "bra" will be used to refer to a brassiere, as known to those skilled in the art. The term "sports bra", a more commonly accepted term in the art, will be used interchangeably with one or more of the following terms, all of which refer to the same type of garment generally used by females for breast support: "sport bra", "sports bra", "sport brassiere", "sports brassiere", "athletic bra" and "athletic brassiere".

Referring to FIGS. 1 through 4, an athletic garment 2, specifically a sports brassiere with breast band utilized for engaging in physical exercise or activities such as running, aerobic exercises, horseback riding, tennis, etc. is shown in FIG. 1. In a first embodiment, the garment 2 has the general form of a brassiere. The garment 2 comprises an inner liner 23, which is preferably made from any soft, smooth, stretchable or otherwise suitable fabric customary to sports bras, breathable material. The inner liner 23 is sewn along the outer stitching 17 and is designed to assist with the wicking of sweat and improve the overall appearance of the external panels 8 and 9. Sewn with or into the inner liner 23 is a breast band sleeve 20, which in embodiments is preferably made from the same fabric as the inner liner 23. The external panels 8 and 9 are also manufactured using any soft, smooth, stretchable or otherwise suitable fabric, and the external panels 8, 9 may be made from a heavier and/or stronger fabric than that used for inner liner 23.

Attached, preferably by reinforced stitching 12, to external panel 9 is a closure, such as a zipper 11. In embodiments, the zipper may be a medium to heavy-duty zipper 11 designed to have a low profile. Behind the zipper 11, attached to inner liner 23 and external panel 9, preferably by sewing, is the zipper protective fabric strip 19. The zipper protective fabric strip 19, which is preferably made from the same fabric as external panel 9, should cover the length and breadth of zipper 11 to ensure the metal and/or plastic portions of zipper 11 are unable to make contact with the wearer's skin or with the breast band 10, which is directly behind zipper 11. Although the embodiments shown in the drawings utilize a zipper as the closure, other types of closures could also be utilized, and these include, but are not limited to, closures such as hook and eye fasteners, hook and loop fasteners, ribbons, laces, buttons, snaps and the like.

The garment 2 is preferably put on like a brassiere or vest with the front portion closed using a closure, such as a zipper 11. The wearer inserts their arms through the arm holes 24 and shoulder straps 8, and adjusts the breast band 10 on the upper portion of the wearer's breasts. With the garment 2 in either a completely open position, or a partially open position (zipper 11 engaged but not completely closed), the wearer can make quick and unassisted adjustments to the breast band 10, and this adjustment can be made in a discrete manner. Situated near the bottommost portion of the external panel 9 is the thoracic torso band 13. The thoracic torso band 13 is sewn into external panel 9 and inner liner 23, and when the garment 2 is zippered, torso band 13 encircles the wearer's chest, comfortably stopping the garment from sliding upwards or downwards. The torso band 13 prevents the garment 2 from riding up on the wearer. The thoracic torso band 13 can be made from any suitable material, but as used in the embodiments described herein, is made from an elastic material commonly used in clothing manufacturing, or similar heavy-duty stretchable nonslip material or fabric, and is positioned between the inner liner 23 and the internal breast band sleeve 20 by methods known to those skilled in the art, such as by sewing.

Figure 2:
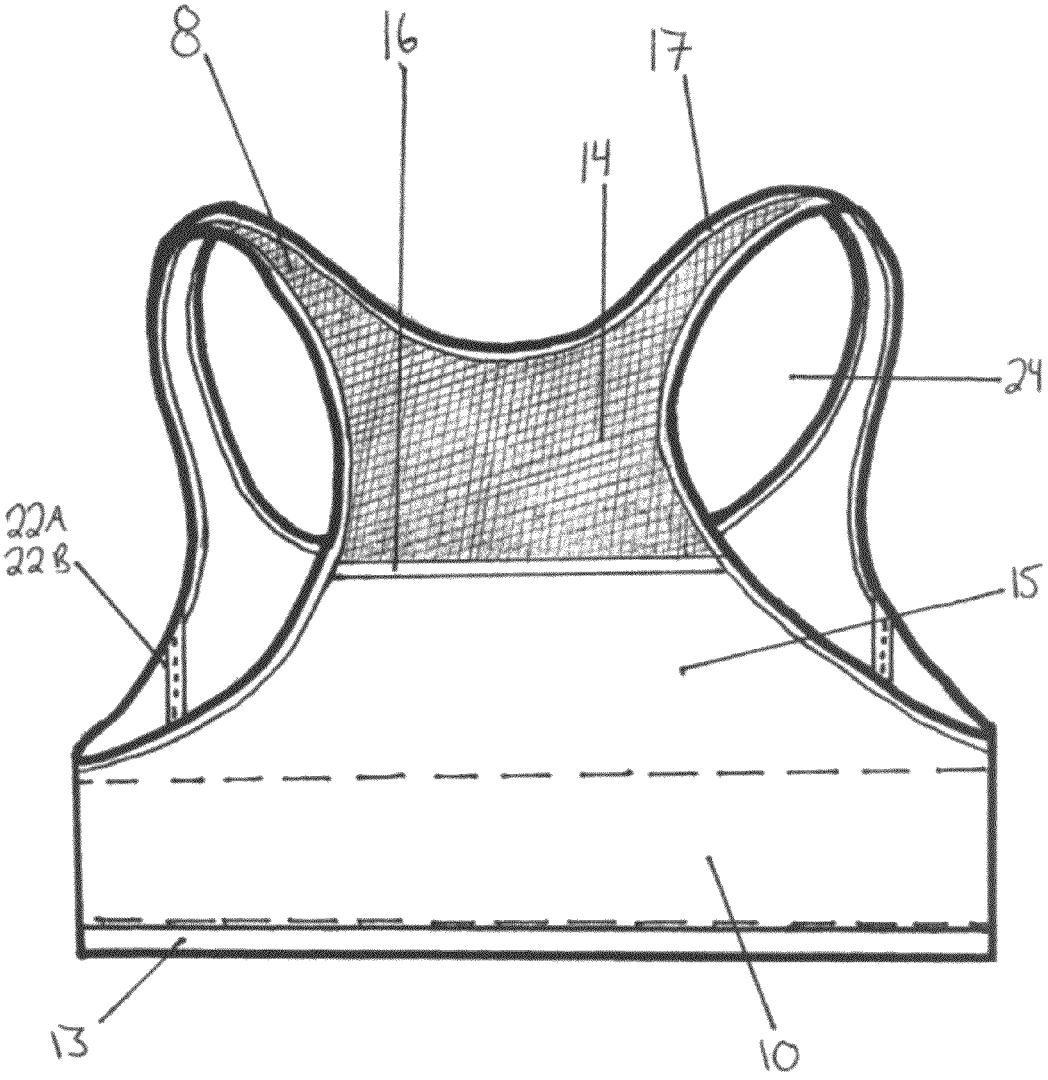
FIG. 2 is a rear perspective view of the embodiment shown in FIG. 1.

FIG. 2 is a perspective view of the garment from the rear with the breast band 10 engaged and front zippered 11. A row of stitching 16 attaches the rear external upper panel 14 to the rear external lower panel 15. The rear panels 14 and 15 may be made from a heavier and/or stronger fabric than the inner liner 23; in an embodiment the rear panels 14 and 15 may be made from any soft, smooth, stretchable or otherwise suitable fabric. There may be multiple rows of stitching 16, and such multiple rows may be referred to herein as reinforced stitching 16; also, if a heavy-duty type of stitching is employed, it too may be referred to herein as reinforced stitching. Reinforced stitching 17 is used around the shoulder strap 8, rear external upper panel 14, rear external lower panel 15; and the backside of the thoracic torso band 13.

Figure 3:
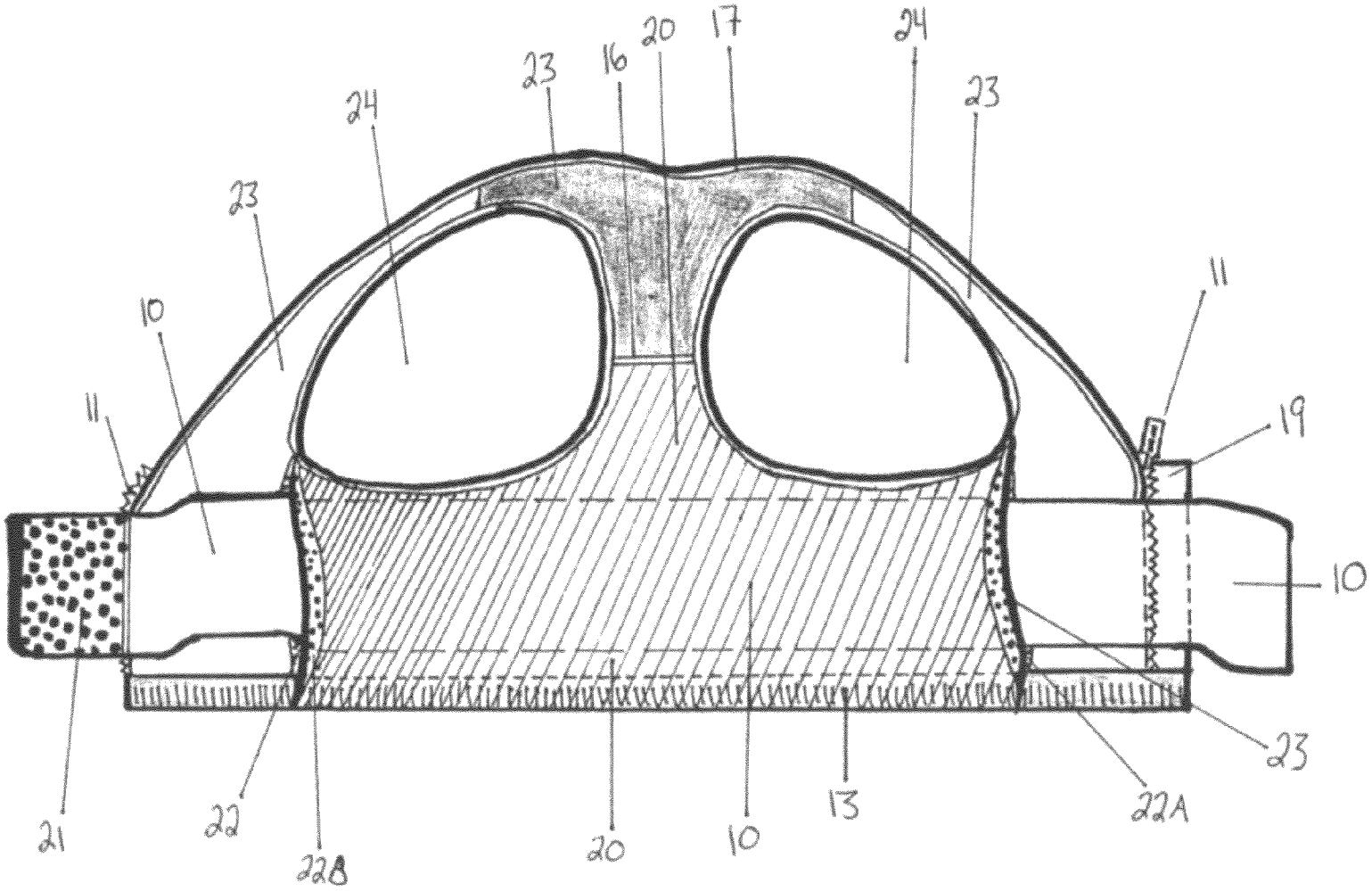
FIG. 3 is a front perspective view of the embodiment of FIG. 1, with the zipper fully unzipped and the rear of the garment laying flat, exposing the inner portion of the garment.

FIG. 3 is a perspective view of the inside of the garment 2. The largest portions of the garment, the inner liner 23, rear external upper panel 14 and rear external lower panel 15, provide the general shape of the garment as a sports bra. The inner liner 23, rear external upper panel 14 and rear external lower panel 15 are joined together by stitching 16. The stitching may comprise a single row of stitching, stitching using a heavy duty material, or may comprise multiple rows of stitching to form reinforced stitching. The inner liner 23 and external panels 8 and 9 are joined together by reinforced stitching 17 around the outer portions of the garment for added stability.

The lower portion of the internal liner 23, below the arm holes 24 and above the thoracic torso band 13, is indicated by the stitching 18, which also marks the location of internal breast band sleeve 18. The internal breast band sleeve 20 is a third fabric layer, and can be the same material used for the internal liner 23, or a different material, depending upon style and/or manufacturing considerations.

The internal breast band sleeve 20 is designed to be wider than the breast band 10 to allow the freedom of upward and downward movement of the breast band 10 over one's breasts to ensure a secure, custom and comfortable fit over one's breasts, in addition to the lateral movement of the breast band 10 (FIG. 3). The breast band 10 is manufactured from a single piece of one fabric, and can be selected from fabrics that have the properties of being soft, stretchable, and firm. In alternate embodiments, the breast band 10 could be made from multiple fabrics, or from more than a single piece of fabric, provided the alternate breast band embodiments have equivalent properties. The breast band 10 comprises a VELCRO® fastener (a hook and loop fastener) 21, a contact sensitive, reusable fastener adjustable on the opposite end of the band to numerous positions since the fastener is able to "grab" the opposite end of the band along its entire length. In one embodiment, the preferred width of the breast band 10 is approximately three inches in width, made from soft, pliable elastic material which may be similar to neoprene and/or an ACE® bandage. In other embodiments, depending upon the size of the garment 2, (i.e., whether a size 34 or a size 44, for example only) the breast band 10 may have a wider or narrower width than that of the embodiment shown in the drawings.

When the breast band 10 is tightened it is placed over the muscular portion and some of the fatty portion of one's breasts and adjusted for comfort and support. By having the breast band 10 encircle the wearer's torso, the breast band 10 will not cinch or crush the wearer's breasts together. Instead, the breast band 10 works with gravity by holding the breast down in a natural manner, and does not allow for excessive upward or downward movement during physical activities. The external panel 9 of the athletic brassiere with breast band is then brought together and zipped 11, concealing a vast majority of the breast band 10. The zipper 11 allows the wearer to make adjustments to the breast band 10 as needed without removing the entire athletic brassiere with breast band.

Protecting the wearer from the zipper 11 is an additional piece of fabric (protective member) 19, similar in construction to the external panel 9. The protective member 19 may have a length that is coextensive with the length of the zipper 11, or may have a length that is greater than the length of the zipper 11. The protective member 19 is joined to the reinforced stitching 17 along the external panel 9, and in embodiments, the protective member has an approximate width of one to one and one half inches. The width of the protective member 19 may also vary, depending upon the size of the garment Also shown in FIG. 3 are the two breast band sleeve openings 22, and the VELCRO® positioners (a hook and loop fastener) 22A, and snap positioners 22B positioned proximate the ends of the sleeve 20. The breast band sleeve openings 22 are located at the distal ends of the internal breast band sleeve 20. These openings 22 are wider than the breast band 10 to allow movement of the breast band 10 enabling the breast band 10 to be placed on the upper portion of the wearer's breasts. For additional control over the breast band 10, the garment may have either VELCRO® positioners (a hook and loop fastener) 22A or snap positioners 22B located between the internal breast band sleeve 20 and the external panel 9. The internal breast band sleeve 20 comprises the bottom portion of the inner liner 23, that is sewn along the outer stitching on the bottom portion of the arm holes 24 and at the reinforced stitching between rear external upper panel and lower panel 16. The sleeve is also sewn along the outer stitching on the thoracic torso band 13. In an embodiment illustrated in the drawings, the internal breast band sleeve opening 20 is approximately five inches in length, to allow adjustment of the breast band 10 for placement on the upper portion of the wearer's breasts.

Once proper placement of the breast band 10 is determined, the breast band 10 is secured in place via the breast band sleeve opening 22 by use of the snap positioners 22B or VELCRO® positioners (a hook and loop fastener) 22A to act as a bridge or stop gap for the breast band 10 to prevent it from sliding vertically within the breast band sleeve opening 22. Depending upon the ultimate size of the garment 2 the length of the internal breast band sleeve opening 20 may differ from the length of the embodiment shown in the drawings.

Figure 4:
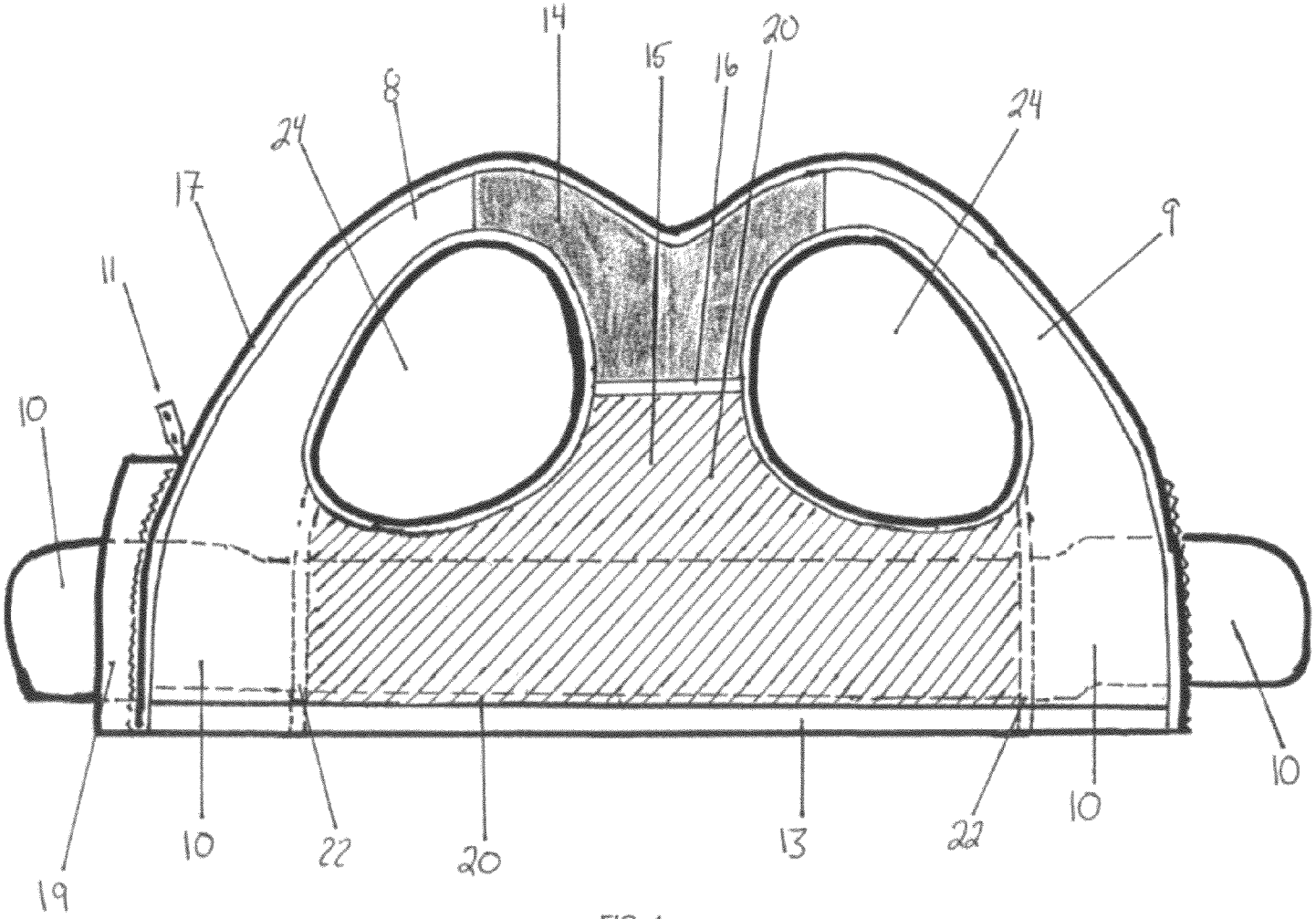
FIG. 4 is a rear perspective view of the embodiment of FIG. 1, with the zipper fully unzipped and the front of the garment laying flat, exposing the outer portion of the garment.

FIG. 4 is a rear perspective view of the embodiment of FIG. 1. The breast band 10 is manufactured from a single piece of fabric. The fabric chosen has the properties of softness, firmness and stretchability. The breast band 10 has a VELCRO® fastener (a hook and loop fastener) 21, preferably on the same side as the protective member 19, a contact sensitive, reusable fastener adjustable on the opposite band to numerous positions since the fastener is able to "grab" the opposite end of the breast band 10 along its entire length. In the embodiment shown in the drawings, the preferred width of the breast band 10 is approximately at least three inches in width, and made from a soft, pliable elastic material which may be similar to neoprene or to the material used in an ACE® bandage. When the breast band 10 is tightened it is placed over the muscular portion and some of the fatty portion of the wearer's breasts and adjusted for comfort. By having the breast band 10 encircle the wearer's torso, the band will not cinch or crush the wearer's breasts together but instead alleviate the upward and downward movement of the wearer's breasts.

Figure 5:
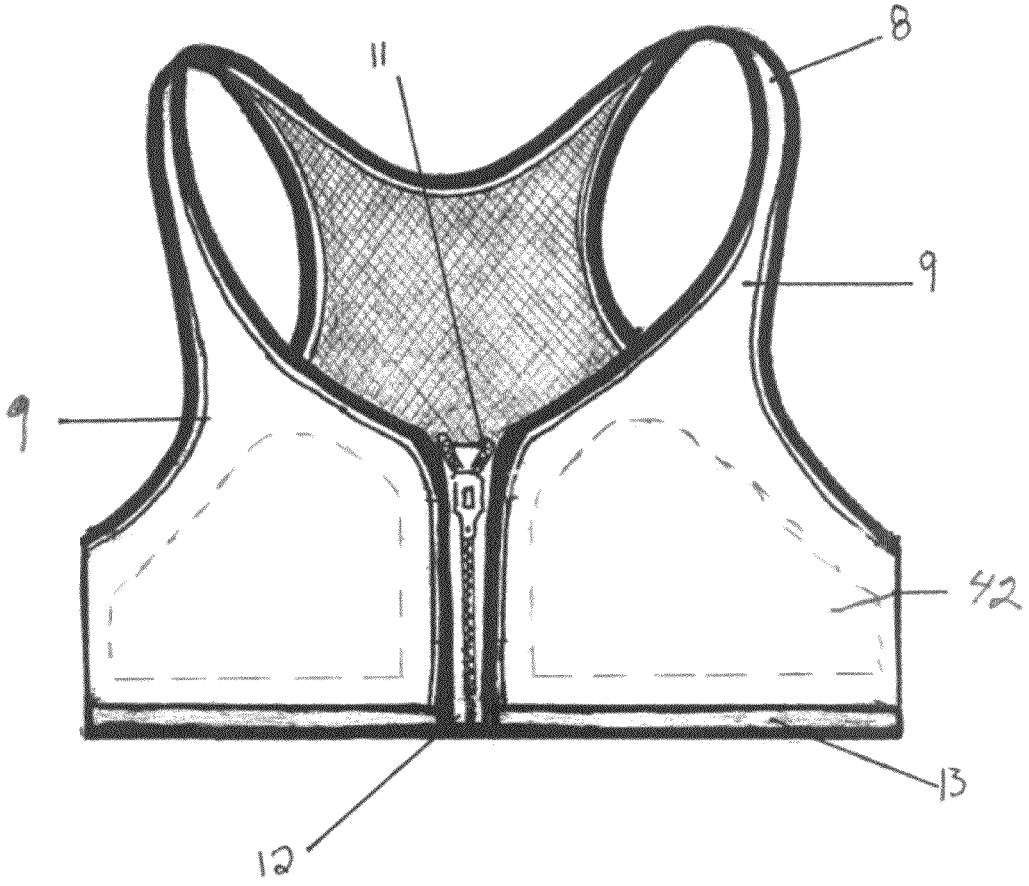
FIG. 5 is a front perspective view of an alternate embodiment of the present invention.

An alternate embodiment of the present invention (FIG. 5) includes cups 42 (shown in phantom) contained within the athletic support brassiere with breast band. The cups provide some shape to the garment, and may be made from materials customarily used, such as foams of various compositions, gels of various compositions, cellulose, silicone, or other materials known to those skilled in the art. This embodiment does include the breast band 10, which is not shown in this FIGURE for purposes of clarity.

Operation of First Embodiment

Referring to FIGS. 1-4, the manner of using the athletic brassiere with breast band 2 is similar to that for most sports bras except in the application of the breast band 10. Specifically, the wearer places her arms through the arm holes 24 and places the athletic brassiere 2 on like a vest, allowing the shoulder straps 8 to lay over the wearer's shoulders. The rear external upper panel 14 and rear external lower panel 15 also lay across the wearer's back with the inner liner 23 in contact with the wearer's skin The athletic brassiere with breast band 2 can be easily and quickly applied and adjusted by the wearer without assistance. The athletic brassiere with breast band 2 has an attractive appearance and can be worn under a separate garment or alone. The athletic brassiere with breast band 2 does not have excessive bulk, complicated harnesses or straps, or gives the appearance of a breast binding apparatus.

The wearer (not shown) of the athletic brassiere with breast band 2 then reaches for the opposite ends of the breast band 10, which extend from the sides of the internal breast band sleeve 20, and pulls the ends together, overlapping the VELCRO® fastener (a hook and loop fastener) 21 onto the breast band 10 to the desired fit. The use of the VELCRO® positioners (a hook and loop fastener) 22A or snap positioners 22B, if constructed into the embodiment, located under the breast band sleeve opening 22, may be used to secure the breast band 10 in plate. The breast band 10 is designed not to cinch the wearer's breast, fully flatten or compress the breasts against the chest wall, or lift and hold the breasts. The breast band 10 alleviate the wearer's breasts from excessive bouncing caused by vigorous exercise or activities such as running, aerobics, horseback riding, and the like. The breast band 10 is adjustable to an infinite number of places along itself. The breast band 10 is contained inside the athletic brassiere with breast band 2 and is concealed via the internal breast band sleeve 20.

Once the breast band 10 is secured, the wearer then pulls the external panels 9 towards the midline of the wearer's body and uses the zipper 11 to bring the panels 9 together, ensuring the zipper protective member 19 is flat against the wearer's skin Embodiments of the present invention are designed to fit the wearer comfortably.

Adjustment of the thoracic torso band 13 into a comfortable position is the final adjustment to the athletic brassiere with breast band 2. The torso band 13 is designed to keep the athletic brassiere with breast band 2 from moving upward over the wearer's breasts during vigorous exercise or stretching.

Because the breast band 10 is removable, it can also be used by itself as a breast support, in which case the wearer wraps the breast band 10 around the chest as described above. The breast band 10 can then be worn under other types of garments, or depending upon the design and appearance of the breast band 10, worn by itself.

Advantages

Based on the description above, a number of advantages of some embodiments of the athletic brassiere with breast band 2 become evident:

(a) Embodiments of the present invention will substantially alleviate a wearer's breasts from excessive upward and downward movement caused by vigorous physical exercise or activities such as running, aerobics, horseback riding, tennis and the like. Excessive upward and downward movement can cause pain as well as physical problems to the breasts such as stretching or tearing of the muscle and fatty tissues.

(b) Embodiments of the present invention have a stretchable breast band, having a VELCRO® fastener (a hook and loop fastener) on one end, which can easily be adjusted to suit the wearer's needs without having to remove the entire garment or having to look for a place of concealment to do so.

(c) Embodiments of the present invention have an attractive appearance and can be worn under a separate garment or alone. Embodiments of the present invention do not have excessive bulk, complicated harnesses or straps, or give the appearance of a breast binding apparatus.

(d) Embodiments of the present invention do not cinch the wearer's breast, fully flatten or compress the breasts against the chest wall, or lift and hold the breasts, but, instead, minimize excessive upward and downward movement of the upper muscular portion and some of the fatty portions of the wearer's breast by use of a breast band, which is inside and concealed within the athletic brassiere with breast band. Embodiments of the present invention work with gravity to hold down the wearer's breasts.

(e) Embodiments of the present invention utilize a zipper to enclose the athletic brassiere with breast band over the wearer's breasts. The front external panels of the athletic brassiere with breast band are brought together and zipped, concealing a vast majority of the breast band. The zipper allows the wearer to make adjustments to the breast band as needed without removing the entire athletic brassiere with breast band. The front zipper closure mechanism provides easy application and removal of the athletic brassiere with breast band while eliminating the need for the wearer's head to pass through the brassiere.

(f) Embodiments of the present invention are designed to fit the wearer comfortably. Many conventional sports bras, even those made specifically for vigorous activities such as running and aerobic exercises, force female athletes to "doubling up" sports bras, that is, wearing two sports bras at one time, one smaller than the other or wearing an ACE® type bandage, which constricts breathing, is difficult and awkward to put on, impossible to adjust without removing an over shirt, is unsightly and bulky, uses metal clips and fasteners to secure the elastic bandage around the chest, and cuts into any loose skin under the arms and back.

Detailed Description: Second Embodiment (FIGS. 6, 7)

Figure 6:
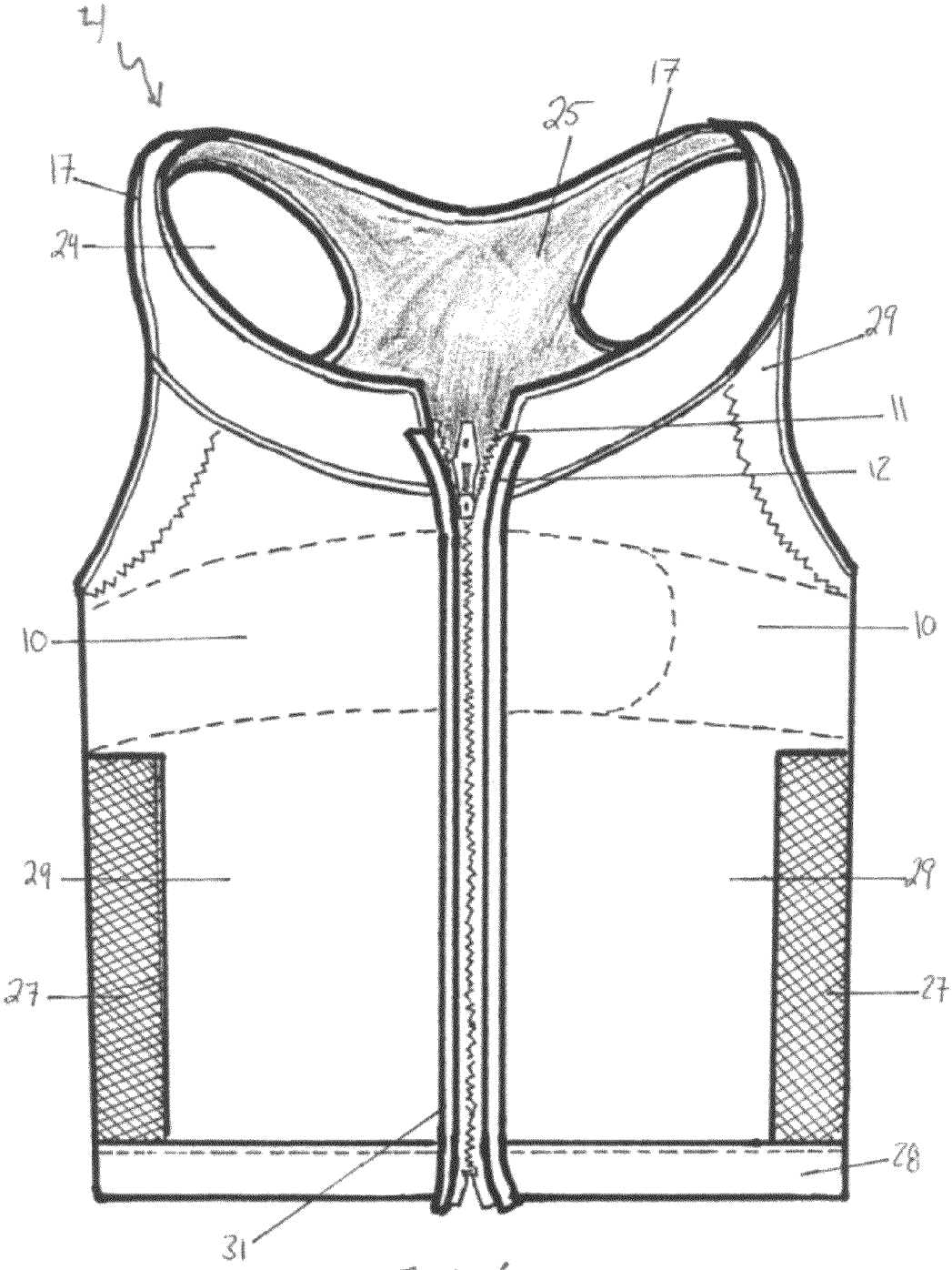
FIG. 6 is a front perspective view of a second embodiment of the present invention.
Figure 7:
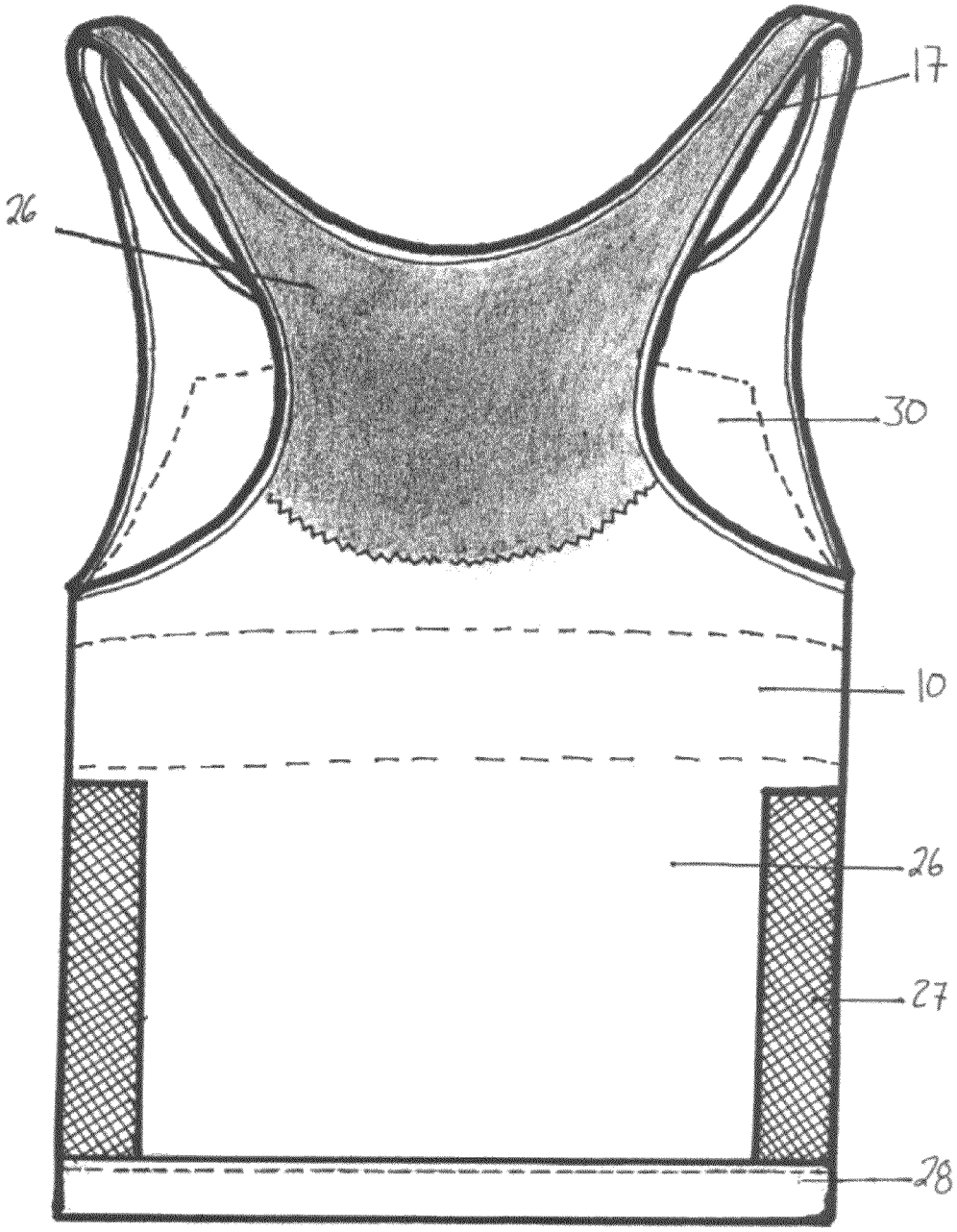
FIG. 7 is a rear perspective view of the embodiment of FIG. 5.

This embodiment is an exercise garment, or athletic support garment 4, specifically a chest-encircling device, called a breast band, enclosed within a full-length exercise shirt with a zippered front (FIGS. 6-7). The garment 4 comprises a one-piece vest front external panel 29, which is preferably made from any soft, smooth, stretchable or otherwise suitable fabric customary to exercise shirts. One particular brand of sports bra garment is available commercially and sold under the DUO-DRY® name (registered trademark of HBI Branded Apparel Enterprises LLC, Winston-Salem, N.C.); other types of exercise garments or support garments are sold by various manufacturers known to those skilled in the art.

Sewn on the outer edges of the vest front external panel 29 is reinforced stitching, which connects the vest front external panel 29 to the vest rear external panel 26 and the vest front internal panel 30 and the vest rear internal panel 25. Attached to the vest front external panel 29 is a zipper 11, preferably a medium to heavy-duty zipper 11 designed to have a low profile. Behind zipper 11, attached to vest front internal panel 30, preferably by sewing is the zipper protective member 31. The zipper protective member 31 is preferably made from the same fabric as the vest front external panel 29, and should cover the length and breadth of zipper 11 to ensure the metal and/or plastic portions of zipper 11 are unable to make contact with the wearer's skin or breast band 10, which is directly behind zipper 11.

The garment 4 is put on like a vest, with the front portion zippered 11. The wearer inserts their arms through the arm holes 24, and adjusts the breast band 10. This allows the wearer to make quick and unassisted adjustments to the breast band 10, discretely. The breast band is held in the breast band sleeve 20, which terminates at the region bounded by reference numeral 18. The use of the VELCRO® positioners (a hook and loop fastener) 22A or snap positioners 22B, if constructed into the embodiment, and located under the breast band sleeve opening 22, may be used to secure the breast band 10 in place so it doesn't move in either a lateral or vertical manner.

At the bottommost portion of the vest front external panel 29 is the waist stitching 28. This stitching is similar to the reinforced stitching 17 in that it protects the edge of the garment from fraying or tearing through use. In addition, sewn into the vest front external panel 29 is a breathable mesh 27. This non see-though mesh 27 allows additional airflow to reach the wearer.

FIG. 7 is a rear perspective view of the embodiment of FIG. 6. The rear external upper panel 26 covers the entire rear portion of the garment 4. Also shown are reinforced stitching 17 and the breathable mesh 27 along the sides of the garment 4.

Operation

Referring to FIGS. 6 and 7, the manner of using this embodiment is similar to the use of the first embodiment, except in the application of the breast band 10. In this alternate embodiment, the wearer places their arms through the armholes 24 and places this alternate embodiment on like a vest allowing the front external panel 29 to lie over the wearer's shoulders. The rear internal panel 25 will lie across the wearer's back, touching the wearer's skin The breast band 10 can be easily and quickly applied and adjusted by the wearer without assistance. The garment 4 has an attractive appearance, and can be worn under a separate garment or alone. The garment 4 does not have excessive bulk, complicated harnesses or straps, or gives the appearance of a breast binding apparatus.

The wearer of this embodiment then reaches for the opposite ends of the breast band 10, which extend from the internal breast band sleeve 20. The wearer pulls both ends together, overlapping the VELCRO® fastener (a hook and loop fastener) 21 onto the breast band 10 to the desired fit. The breast band 10 is designed not to cinch the wearer's breast, fully flatten or compress the breasts against the chest wall, or lift and hold the breasts, but, instead, substantially alleviate the wearer's breasts from excessive upward or downward movement caused by vigorous physical exercise or activities such as from running, aerobics, horseback riding, tennis and the like. The breast band 10, housed inside this embodiment, is concealed in the internal breast band sleeve 20 underneath the vest front external panel 29 and internal panel 25, is adjustable to an infinite number of positions and may be secured in place via VELCRO® positioner (a hook and loop fastener) 22A or snap positioner 22B.

Once the breast band 10 is secured, the wearer then pulls the front external panels 29 towards the midline of the wearer's body and using the zipper 11, closes the panels 29 together, ensuring that the zipper protective member strip 31 is flat against the wearer's skin. Embodiments of the present invention are designed to fit the wearer comfortably, and are adjustable to fit any wearer's breasts.

Advantages: Second Embodiment

From the description above, a number of advantages of some embodiments of the full length exercise shirt become evident:

(a) Embodiments of the present invention will substantially alleviate a wearer's breasts from excessive upward and downward movement caused by vigorous physical exercise or activities exercise such as from running, aerobics, horseback riding, tennis, and the like. Excessive upward and downward movement can cause pain and physical problems to the breasts such as stretching or tearing of the muscle and fatty tissues.

(b) Embodiments of the present invention have a stretchable breast band, having a VELCRO® fastener (a hook and loop fastener) on one end, which can easily be adjusted to suit the wearer's needs without having to remove the entire garment or having to look for a place of concealment to do so.

(c) Embodiments of the present invention have an attractive full length appearance, which covers the wearer's abdomen and can be worn alone, without excessive bulk, complicated harnesses or straps, or give the appearance of a breast binding apparatus.

(d) Embodiments of the present invention do not cinch the wearer's breast, fully flatten or compress the breasts against the chest wall, or lift and hold the breasts, but, instead, minimize excessive upward and downward movement of the wearer's breast by use of a breast band, which is inside the garment. Embodiments of the present invention work with gravity to hold down the wearer's breasts.

(e) Embodiments of the present invention utilize a closure, such as a zipper, to enclose the exercise shirt over the wearer's breasts. The external panels of the athletic brassiere with breast band are brought together and zipped, concealing the breast band. The zipper allows the wearer to make adjustments to the breast band as needed without removing the entire garment.

(f) Embodiments of the present invention are designed to fit the wearer comfortably. Many conventional sports bras, even those made specifically for vigorous activities such as running and aerobic exercises, force female athletes into "doubling up" sports bras, i.e., wearing two sports bras at one time, one smaller than the other or wearing an ACE® type bandage, which constricts breathing, is difficult and awkward to put on, impossible to adjust without removing an over shirt, is unsightly and bulky, uses metal clips and fasteners to secure the elastic bandage around the chest, and cuts into any loose skin under the arms and back.

Figure 8:
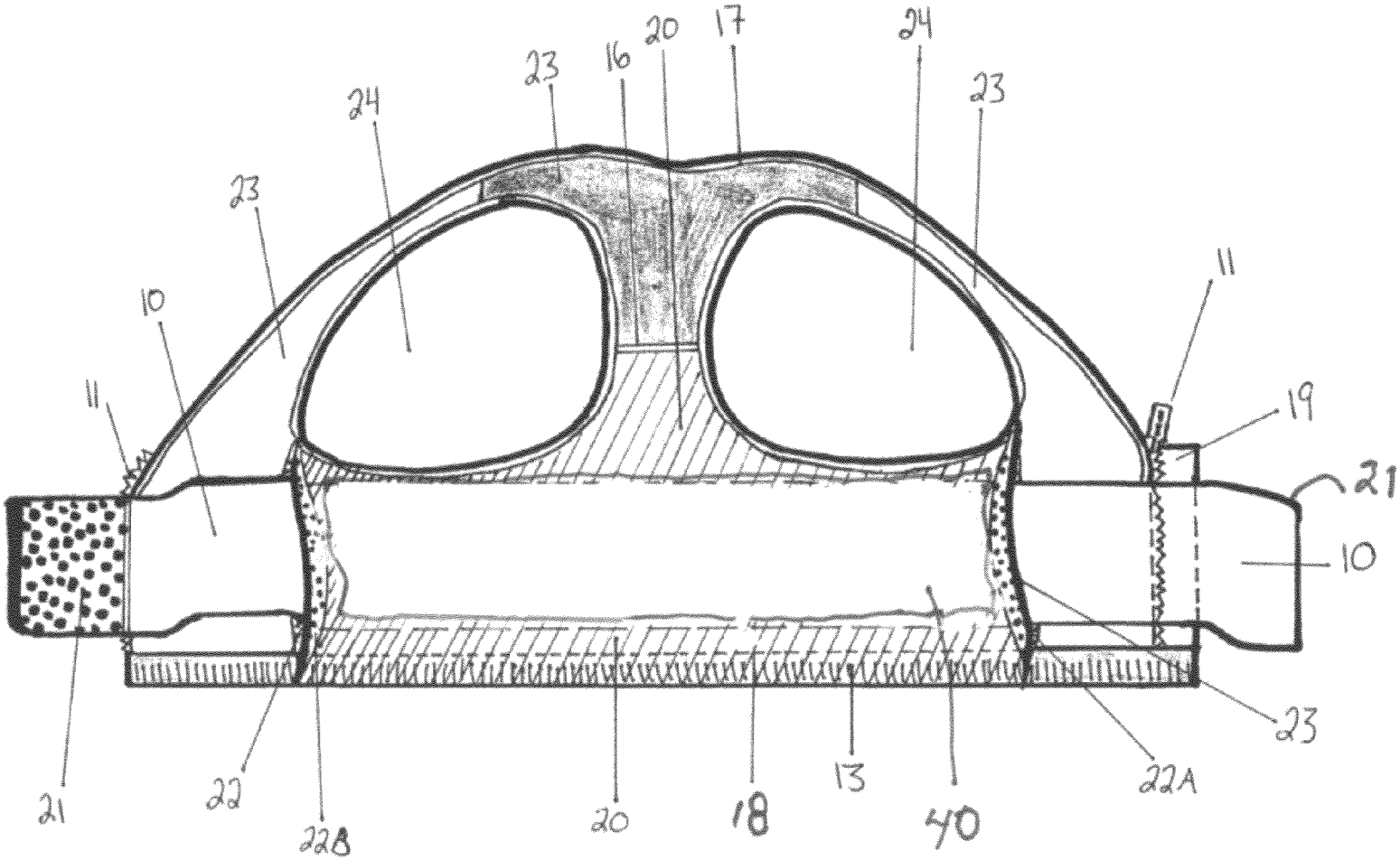
FIG. 8 is a front perspective view of another embodiment of the present invention, showing the protective strip covering the internal breast band sleeve.

Another embodiment of the present invention includes an inner protective strip 40 (FIG. 8). The protective strip 40 is attached to an upper portion of the internal breast band sleeve 20, and covers the internal breast band sleeve 20. The protective strip 40 can be as long as, longer, or shorter than the length of the breast band covering 20, and its width can be sufficient to cover the region covering the breast band 10. The protective strip 40 serves to reduce chafing or rubbing of the internal breast band covering 20 against the skin of the wearer.

Figure 9:
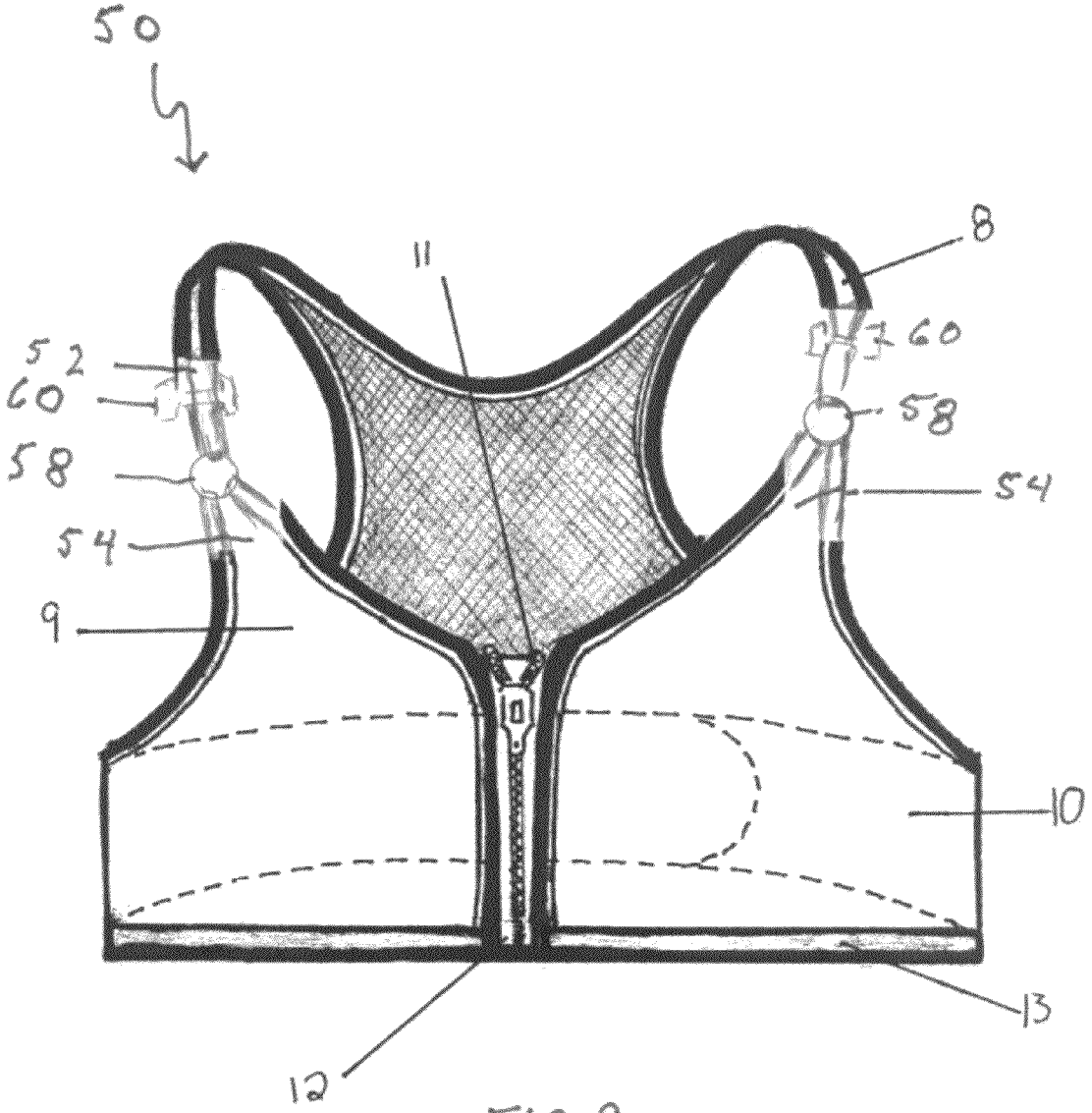
FIG. 9 is a front perspective view of another embodiment of the present invention, showing the adjustable straps.

Another embodiment (FIG. 9), of the athletic sports brassiere 50 includes a pair of adjustable straps 52 attached to the external panel 54 at attachment piece 58. In this embodiment, a buckle 60 is mounted on each strap 52. An end of the strap 52 is threaded through the attachment piece 58, thus forming a loop, and then returned to buckle 60 where it is secured, in a manner that is commonly utilized in the industry. The embodiment in FIG. 8 illustrates the straps being adjustable from the front of the athletic sports brassiere 50; in another embodiment (not shown) the buckle 60 can be mounted on either the back portion and/or the front portion of the strap 52.

Conclusion, Ramifications, and Scope

Accordingly, embodiments of the athletic brassiere with breast band of the present invention are designed to be comfortable for the wearer and effective in their operation. The closure design, utilizing a zipper, allows easy application and removal of athletic brassiere with breast band, allows the wearer to make adjustments to the breast band without removing the entire garment over one's head, and to quickly and easily remove the athletic brassiere with breast band when it is no longer needed. The athletic brassiere with breast band is designed to fit one like a traditional brassiere, instead of forcing one to purchase a sports brassiere which is one or two sizes too small in an attempt to overly compress one's breasts to stop them from bouncing during vigorous physical exercise or activities. Embodiments of the athletic brassiere with breast band, itself, are designed to be attractive in appearance; and designed to be worn either under another garment, or by itself, without giving the appearance of an embarrassing breast binding contraption or apparatus. In embodiments, the breast band is designed to be about three inches wide and made of a stretchable fabric which may be similar to an ACE® bandage and/or neoprene. Utilizing a fastener such as VELCRO® (a hook and loop fastener), the breast band can easily be adjusted to fit one's desired comfort level. Furthermore, embodiments of the athletic brassiere with breast band have additional advantages in that:

- it will eliminate excessive upward and downward movement of the breasts, which can cause pain and physical problems to the breasts such as stretching or tearing of the muscle and fatty tissues;
- the breast band is adjustable, which allows the band to be placed on the wearer's breasts and may be secured in place with the use of a fastener such as snaps or a VELCRO® (a hook and loop fastener) strip;
- it can easily be adjusted to suit the wearer's needs without having to remove the entire garment or to be required to look for a place of concealment to do so;
- it has an attractive appearance and can be worn under a separate garment or alone, without excessive bulk, complicated harnesses or straps, or giving the appearance of a breast binding apparatus;
- it does not cinch the wearer's breast, fully flatten or compress the breasts against the chest wall, or lift and hold the breasts, but, instead alleviates the upward and downward movement of the wearer's breast, by use of a breast band, which is housed inside the garment and concealed in the breast band sleeve. Placement of the breast band is adjustable to allow placement on the wearer's upper portion of the breasts
- The breast band is removable for washing of the embodiments;
- The breast band can be used by itself as a breast support; and
- The breast band can be worn under other types of garments.

Therefore, although embodiments of the present invention have been described with a certain degree of particularity, it is to be understood that the present disclosure has been made only by way of illustration and that numerous changes in the details of construction and arrangement of parts may be resorted to without departing from the spirit and scope of the invention.

These specificities should not be construed as limitations on the scope of any embodiment, but as exemplifications of the presently preferred embodiment thereof. Many other ramifications and variations are possible within the teachings of the various embodiments. For example, the outer and inner panels can be constructed out of a variety of fabrics; the breast band can vary in length, width, and fabric construction; the breast band may be held in place by snaps, VELCRO® (a hook and loop fastener) strips or other means, the athletic brassiere with breast band itself may be in the shape of a vest.

In addition to utilizing a mesh to effect some ventilation, other fabrics can be used that either have wicking properties, or cooling properties, such as materials manufactured by Outlast Technologies, Inc., Boulder Colo. (based on the use of phase change technologies, a technology that was developed by the National Aeronautics and Space Administration for fabrics to affect temperature control of space suits and accessories) and other companies.

Although the present specification describes the athletic brassiere as a garment intended for use by females, it is to be understood that by various modifications, primarily in the size of the garment, the cups and the width of the breast band, embodiments of the athletic brassiere of the present invention could be utilized by large-breasted males, who may have some of the same problems as described herein.

Although not shown in the drawings, another embodiment can be prepared comprising a side closure rather than a frontal closure, and the breast band can be adjusted from the side of the garment. Other variations, not shown in the drawings, can position the closure at points other than the center of the front, or with the closure at an angle other than almost perpendicular with respect to the base of the garment, yet still allowing for access to the breast band and enabling both lateral and vertical adjustment thereof. Yet another embodiment, not shown in the drawings, can utilize a rear closure with the breast band being adjusted from the rear of the garment prior to closure zipper Thus the scope of the present invention should be determined by the appended claims and their legal equivalents, and not by the examples given.

What is claimed is:

1. An athletic brassiere to prevent breast movement of a wearer engaged in physical activity, the athletic brassiere comprising:

- a torso encircling inner liner, the inner liner including an end;
- an outer liner, the outer liner including an end, the outer liner being coextensive with the inner liner, the liners joined together by stitching;
- the athletic brassiere further comprising arm holes formed within the liners;
- a means for closing the athletic brassiere, the means for closing being attached to the liners at an end of the liners;
- the inner liner further comprising a panel proximate each of the ends of the liner, the panel for receiving a breast of the wearer;
- a tubular sleeve attached to the inner liner, the tubular sleeve having a length, and the tubular sleeve sized to receive a breast band; and
- a breast band, the breast band being longer than the tubular sleeve, the breast band being slidably retained within the tubular sleeve, the breast band having a pair of ends, the ends comprising a means for fastening the breast band for retaining the breasts of the wearer when the breast band is wrapped around the wearer and the breast band fastened by the means for fastening, and
- wherein the breast band lies over the breasts of the wearer and retains the breasts towards the torso of the wearer.

2. The athletic brassiere as described in claim 1, wherein the breast band is elastic.

3. The athletic brassiere as described in claim 2, wherein the breast band is removable.

4. The athletic brassiere as described in claim 2, wherein the inner liner tubular sleeve further comprises a positioner, and the breast band can interact with the positioner to secure the breast band to the athletic brassiere after the breast band has been adjusted by the wearer.

5. The athletic brassiere as described in claim 2, wherein the means for fastening is selected from the group consisting of a hook and loop fastener, a hook and eye, a snap, a zipper, a button, a lace and an elastic material.

6. The athletic brassiere as described in claim 2, wherein the means for closing is a zipper, and when the athletic brassiere is closed the zipper is positioned at a front midline of the athletic brassiere.

7. The athletic brassiere as described in claim 2, wherein the means for closing is a zipper, and when the athletic brassiere is closed the zipper is positioned at a side of the athletic brassiere.

8. The athletic brassiere as described in claim 6, further comprising a protective member, the protective member attached to the liner and positioned behind the zipper, the protective member minimizing frictional contact between the zipper and the wearer.

9. The athletic brassiere as described in claim 2, further comprising a means for limiting the movement of the breast band, the means for limiting positioned proximate an end of the tubular sleeve, the means for limiting being engaged to limit the movement of the breast band.

10. The athletic brassiere as described in claim 6, further comprising a cover flap for the breast band.

11. The athletic brassiere as described in claim 2, wherein the liners are manufactured from a polyester phase change fabric.

12. The athletic brassiere as described in claim 2, wherein the liner further comprises an attachment point, and the liners further comprise a strap and a buckle, the strap being attached to the athletic brassiere at the attachment point, and the strap being slidably retained in the buckle.

13. The athletic brassiere as described in claim 12, wherein the buckle is positioned on the strap front.

14. An elongated exercise garment to prevent breast movement of a wearer engaged in vigorous physical activity, the exercise garment comprising:

a torso encircling inner liner the inner liner including an end;;

an outer liner, the outer liner including an end; the outer liner being coextensive with the inner liner, the liners joined together by stitching;

the exercise garment further comprising arm holes formed within the liners;

a means for closing the exercise garment, the means for closing being attached to the liners at an end of the liners;

the inner liner further comprising a panel proximate each of the ends of the liner, the panel for receiving a breast of the wearer a tubular sleeve attached to the inner liner, the tubular sleeve having a length, and the tubular sleeve sized to receive a breast band and a breast band, the breast band being longer than the tubular sleeve, the breast band being slidably retained within the tubular sleeve, the breast band having a pair of ends, the ends comprising a means for fastening, the breast band for retaining the breasts of the wearer when the breast band is wrapped around the wearer and the breast band fastened by the means for fastening and wherein the breast band lies over the breasts of the wearer and retains the breasts towards the torso of the wearer.

15. The exercise garment as described in claim 14, wherein the breast band is elastic.

16. The exercise garment as described in claim 15, wherein the breast band is removable.

17. The exercise garment as described in claim 14, wherein the inner liner sleeve further comprises a positioner, and the breast band can interact with the positioner to secure the breast band to the athletic brassiere after the breast band has been adjusted by the wearer.

18. The exercise garment as described in claim 14, wherein the means for closing is a zipper, and when the exercise garment is closed the zipper is positioned at a front midline of the exercise garment.

19. The exercise garment as described in claim 18, wherein the means for fastening is selected from the group consisting of a hook and loop fastener, a hook and eye, a snap, a zipper, a button, a lace and an elastic material.

20. The exercise garment as described in claim 18, further comprising a protective member, the protective member attached to the liner and behind the zipper, the protective member minimizing frictional contact between the breast band and the zipper.

21. The exercise garment as described in claim 20, wherein the protective member is attached near the midline.

22. The exercise garment as described in claim 15, further comprising an inner protective liner, the protective liner being attached proximate the internal breast band sleeve, and having dimensions sufficient to cover the internal breast band sleeve.

23. The exercise garment as described in claim 22, wherein the inner protective liner is attached proximate the top and the bottom of the internal breast band sleeve.

24. The exercise garment as described in claim 15, wherein the liners are manufactured from a polyester phase change fabric.

25. A method to prevent breast movement of a wearer engaged in physical activity, comprising the steps of:

putting on a garment, the garment comprising:

a torso encircling inner liner the inner liner including an end;;

an outer liner the outer liner including an end; the outer liner being coextensive with the inner liner, the liners joined together by stitching;

the garment further comprising arm holes formed within the liners;

a means for closing the garment, the means for closing being a zipper attached to the liners at an end of the liners;

the inner liner further comprising a panel proximate each of the ends of the liner, the panel for receiving a breast of the wearer;

a tubular sleeve attached to the inner liner, the tubular sleeve having a length, and the tubular sleeve sized to receive a breast band; and an elastic breast band, the breast band being longer than the tubular sleeve, the breast band being slidably retained within the tubular sleeve, the breast band having a pair of ends, the ends comprising a means for fastening;

inserting the wearer's arms within the arm holes;

securing the breast band around the chest of the wearer; and adjusting the breast band in a lateral direction and wherein the breast band lies over the breasts of the wearer and retains the breasts towards the torso of the wearer.

26. The method as described in claim 25, further comprising the step of adjusting the breast band in a vertical direction.

27. The method as described in claim 26, further comprising the step of closing the zipper to secure the garment.

* * * * *